United States Patent [19]

Rannenberg

[11] 4,295,518

[45] Oct. 20, 1981

[54] COMBINED AIR CYCLE HEAT PUMP AND REFRIGERATION SYSTEM

[75] Inventor: George C. Rannenberg, Canton, Conn.

[73] Assignee: United Technologies Corporation, Hartford, Conn.

[21] Appl. No.: 44,840

[22] Filed: Jun. 1, 1979

[51] Int. Cl.[3] ..... F25B 13/00

[52] U.S. Cl. ..... 165/2; 165/48 S; 165/62; 62/95; 62/401; 417/366

[58] Field of Search ..... 237/2 B; 165/2, 15, 165/DIG. 12, 48 S, 62; 62/401, 402, 324 B, 95; 126/247; 417/368, 366

[56] References Cited

U.S. PATENT DOCUMENTS 2,602,307 7/1952 Collison ..... 62/401 X 3,191,403 6/1965 Ladusaw ..... 62/505

*Primary Examiner*—Albert W. Davis

*Assistant Examiner*—Margaret A. Focarino

*Attorney, Agent, or Firm*—Donald F. Bradley; John Swiatocha

[57] ABSTRACT

In an air conditioning system for a load, air is used as the refrigerant, and identical components including a turbo-compressor and a regenerative heat exchanger are used for both cooling in the refrigeration mode and heating in the heat pump mode. A plurality of valves are arranged so that in the refrigeration mode the refrigerant air operates in a closed dry air loop to avoid problems associated with moisture. In the heat pump mode the valves are arranged to cause the refrigerant air to operate open loop by using ambient air as the input to the cycle, and avoiding icing problems by rejecting the refrigerant air, together with any ice present, back into the ambient. Operation closed loop in the refrigeration mode and open loop in the heat pump mode results in maximum cycle efficiency with minimum difficulty caused by moisture entrained in the refrigerant air.

11 Claims, 4 Drawing Figures

COMBINED AIR CYCLE HEAT PUMP AND REFRIGERATION SYSTEM

BACKGROUND OF THE INVENTION

1. Field of the Invention

This invention relates to a regenerative air cycle heat pump and refrigeration system in which identical components are used, the components being switched from one mode to the other by simultaneous switching of a plurality of two-way valves. More specifically, this invention uses air as both a heating and cooling medium for a load. The air refrigerant may be used directly to heat or cool the load, or a recirculation fluid such as water may be used in heat transfer relationship with the heated or cooled air.

2. Description of the Prior Art

The term "heat pump" is another name for "refrigeration machine". All refrigeration machines take heat from a low temperature source and deliver it to a higher temperature sink. The quantity of the heat given off at the higher temperature sink is always exactly equal to the heat removed from the low temperature source, plus the heat equivalent of the power input to run the refrigeration machine. Thus, all refrigeration machines, whether Freon, air cycle, Sterling cycle, Brayton cycle, etc., reject more heat at their higher temperature sink than the heat equivalent of their input power. When any refrigeration machine is used to cool outside air in the winter and reject this heat inside a building, the heat rejected in the building must be greater than the heat equivalent of the power it takes to run the machine. This increment of heat is "free" from a fuel consumption point of view.

The air cycle heat pump is an alternate to the well known Freon heat pump primarily because the Freon heat pump has several disadvantages which are serious enough to prevent its general use. First, in the Freon heat pump heat is absorbed from the ambient by heat transfer, with the cold surface of necessity colder than ambient. When the weather becomes cold, ice forms on the cold heat transfer surface of the Freon evaporator. The ice creates problems not present with the air cycle, because the presently disclosed open air cycle heat pump does not reject its heat through a heat transfer surface. Second, as the weather gets colder, the available heat capacity of a Freon heat pump decreases, while the requirement for heat obviously increases. The presently disclosed air cycle heat pump has relatively constant heating capacity as the weather gets colder. Third, buildings are normally heated with air or water supplied at a temperature of about 150° F. (66° C.). On a day with a temperature of 30° F. −1° C.), which is average winter weather over most of the United States and Europe, this requires an evaporator temperature of about 0° F. (−18° C.) and a condensor for the Freon heat pump at a temperature of about 160° F. (71° C.). This in turn requires a Freon compressor pressure ratio of about 25 to 1. The disclosed air cycle heat pump on a similar day provides about 150° F. (66° C.) air for heating with a compressor pressure ratio of less than 2 to 1, so that a much simpler aerodynamic compressor may be used rather than a high pressure ratio positive displacement compressor. Fourth, Freon leakage contributes to high initial cost and high maintenance cost for Freon heat pumps. Air cycle heat pumps may leak also, but air leaks are of little consequence.

Prior art air cycle heat pumps suffer both from lack of efficiency and from problems caused by icing. The present invention overcomes both of these problems by virtue of the novel use of a regenerative heat exchanger upstream of the cooling turbine to reduce turbine inlet temperature close to the heat source temperature, combined with the turbine discharge air being discharged to ambient at a temperature far below heat source temperature. This novel construction maximizes the free heat and minimizes ice problems by directly rejecting the turbine discharge air into the ambient in the heat pump mode, whereas prior art systems cool the ambient air by passing it through a cold heat exchanger which is not required in the present disclosure, the cold heat exchanger often becoming clogged with ice. Further, by virtue of the novel construction including switchable two-way valves, the same components may be used for both the heat pump and refrigeration modes.

It is therefore an object of this invention to provide an air cycle heat pumping and refrigeration system in which the adverse effects of moisture in the refrigerant air are minimized.

Another object of this invention is to provide the maximum possible thermodynamic cycle efficiency for air cycle heat pumping and refrigeration by virtue of the appropriate use of a regenerative heat exchanger.

Another object of this invention is a regenerative air cycle heat pump and refrigeration system utilizing the same components for both the heat pump and refrigeration modes.

A further object of this invention is the use of a plurality of two-way air valves which are simultaneously operated to switch the air cycle system between heat pump and refrigeration modes.

SUMMARY OF THE INVENTION

In accordance with the present invention there is provided a combined regenerative air cycle heat pump and refrigeration system in which the major components may be switched between the refrigeration mode and the heat pump mode by the simultaneous operation of a plurality of two-way air valves. The major components of the system are a motor-powered turbocompressor, a means for absorbing heat from the ambient and rejecting it to the load for heating, a means for absorbing heat from the load and rejecting it to the ambient for cooling, and a plurality of valves for switching between the heating and cooling modes as required by the conditioning requirements of the load.

A primary feature of the invention is the use of a regenerative heat exchanger upstream of the cooling turbine to reduce turbine inlet temperature close to the heat source temperature, combined with the turbine discharge air being discharged to ambient at a temperature far below heat source temperature. Moisture may be removed from the air in the regenerative heat exchanger prior to its expansion in the turbine to further reduce icing problems.

Two embodiments of the invention are shown, one illustrating the invention for heating or cooling air which is supplied to the load, and the other for heating or cooling another recirculation fluid such as water which is supplied to the load. Both embodiments operate open loop in the heat pump mode with the refrigerant air constantly changed rather than being recirculated. In the refrigeration mode, the turbine discharge is always above 32° F. (0° C.) so that ice in the turbine discharge is not a problem, and therefore the turbine discharge is not discharged directly to the ambient.

By operating open loop in the heat pump mode, the moisture in the air is constantly rejected to the ambient at the turbine discharge, minimizing potential problems which could be caused by ice. Further, no cold heat rejection heat exchanger is needed to pick up heat from the ambient air for heat pump action, and the ambient air is cooled by directly rejecting the turbine discharge air into the ambient without a cold heat rejection heat exchanger which obviously cannot clog from icing.

DESCRIPTION OF THE PREFERRED EMBODIMENT

Figure 1:
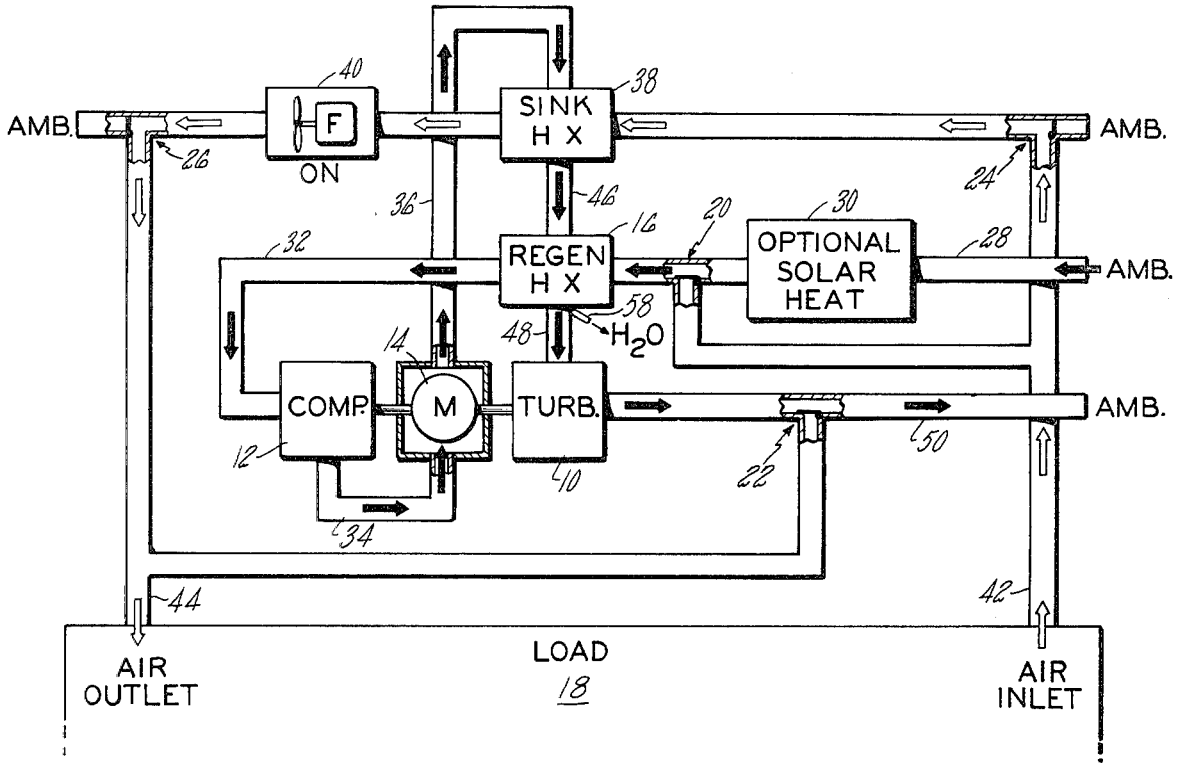
FIG. 1 is a schematic diagram of an air cycle heat pump system used for heating air returning from a load and returning this heated air to the load.

With respect to FIGS. 1–4, the components common thereto are shown by the same reference numerals, and include a turbine 10 which is mechanically connected to and supplies a portion of the power required by a compressor 12, the remainder of the compressor power being supplied by an electric drive motor 14. Also an essential part of each embodiment is a regenerative heat exchanger 16 located upstream of the turbine for reducing the temperature of the refrigerant at the turbine inlet to as close to ambient or source temperature as possible, the ultimate purpose thereof being to cause the turbine outlet air to be as cool as possible, maximizing system efficiency; the regenerative heat exchanger 16 also serves the purpose of removing any moisture from the refrigerant prior to its expansion in the turbine.

Also required in each embodiment are a plurality of two-way air valves which permit switching of the system between heat pump and refrigeration modes, and additional sink and/or fluid heat exchange means, the additional heat exchange means absorbing heat from the ambient and rejecting it to the load in the heat pump mode, and absorbing heat from the load and rejecting it to the ambient during the refrigeration mode. The load 18 will be assumed to be a building which it is desired to heat or cool, although the invention applies to other loads as well.

Figure 2:
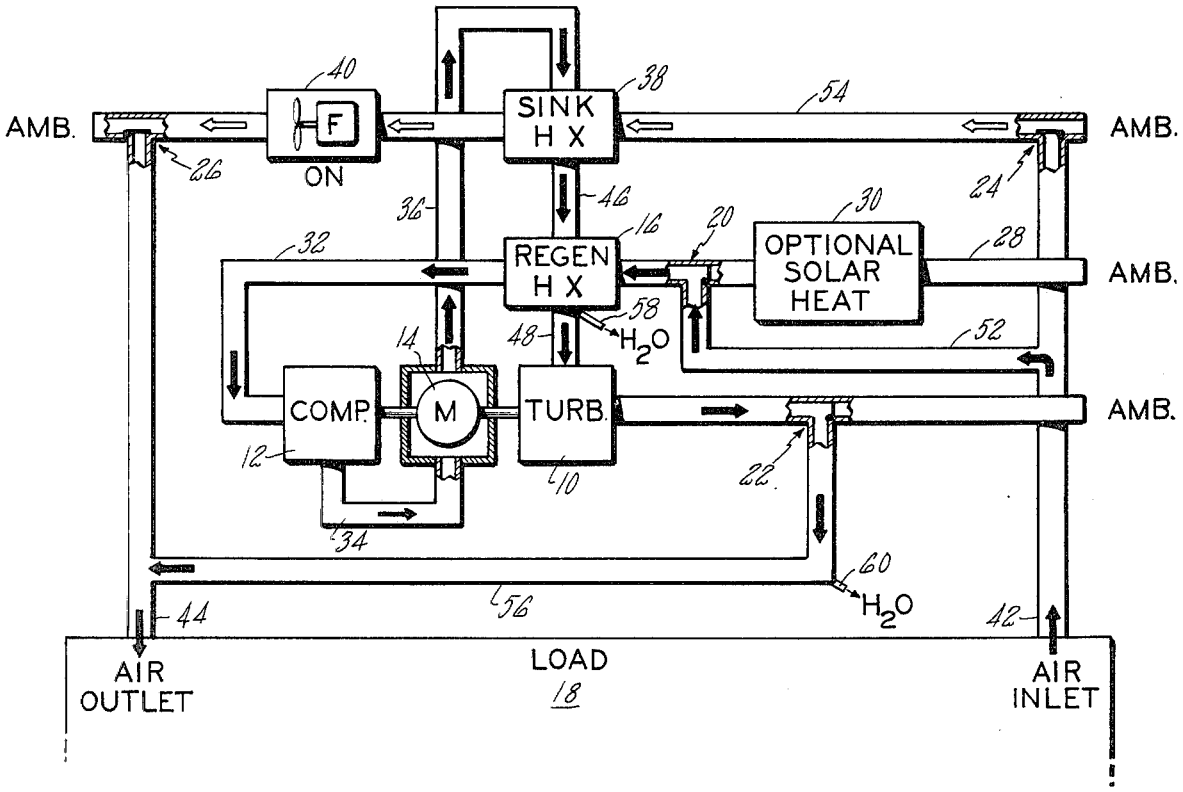
FIG. 2 is a schematic diagram of an air cycle refrigeration system using components identical to those of FIG. 1 for cooling air returning from a load and returning this cooled air to the load. The cooling being accomplished by switching a plurality of valves.

In FIGS. 1 and 2, the heating and cooling is applied to the load by recirculation air in the manner utilized by present day homes with a hot air heating system in which the heating ducts are also used in warm weather for air conditioning. The heating mode is shown in FIG. 1. Four two-way air valves indicated by numerals 20, 22, 24 and 26 are shown. In FIG. 1 ambient air is fed via duct 28, through an optional solar heated exchanger 30, and through valve 20 to the ambient pressure side of regenerative heat exchanger 16. The solar heat exchanger 30 has no effect on the system except to increase the heat rejected to the load and, therefore somewhat improve the heat output with negligible effect on input power. Its inclusion in the system is entirely a question of economics versus efficiency.

After passing through the ambient pressure side of regenerative heat exchanger 16, where some heat is added to the ambient air, as will be described, the refrigerant ambient air is fed via duct 32 to compressor 12 where the air is compressed, being raised in pressure and temperature. As noted previously, compressor 12 is driven by expansion turbine 10 which supplies some of the torque, the remainder being provided by motor 14. After leaving the compressor 12, the refrigerant air proceeds via duct 34 across the motor 14 in order to cool the motor windings and obtain useful heat from the motor inefficiencies. The high temperature, high pressure refrigerant air then proceeds, via duct 36 to sink heat exchanger 38, where it is used to heat air recirculated from load 18. The load recirculation air, propelled by fan 40, enters inlet duct 42 in load 18 and passes through valve 24, through the sink heat exchanger 38, fan 40, valve 26 and then back to load 18 via outlet duct 44. After giving up its heat in the sink heat exchanger 38 to the load recirculation air, the compressed refrigerant air, now lowered in temperature, proceeds via duct 46 to the high pressure side of regenerative heat exchanger 16 where the refrigerant air is used to heat the ambient air taken into the system at duct 28. The refrigerant air, now further reduced in temperature, then proceeds via duct 48 to the expansion turbine 10 where it is dropped in pressure and is cooled prior to its rejection into the ambient via valve 22 and duct 50.

The heat pump system of FIG. 1 has been modified in FIG. 2 to act as a refrigeration system for cooling the load 18. The modifications consist exclusively of varying the positions of the four two-way valves 20, 22, 24 and 26. In this mode warm recirculation air is provided from the load at inlet duct 42 and fed via duct 52 and through valve 20 to the ambient pressure side of regenerative heat exchanger 16. In this embodiment the recirculation air is used as the refrigerant air. The path from duct 28 through solar heat exchanger 30 to the regenerative heat exchanger 16 has been blocked by the switching of valve 20. Likewise, the flow of recirculation air through valves 24 and 26 has also been blocked. The path of the refrigerant air from the regenerative heat exchanger 16 to the turbine discharge is the same as in FIG. 1, viz., via duct 32 to compressor 12, then via duct 34 through the windings of motor 14, then via duct 36 to sink heat exchanger 38 where the compressed refrigerant air, now at high temperature and pressure, gives up some of its heat to ambient air passed through the sink heat exchanger 38 via valve 24, duct 54, fan 40 and back to ambient via valve 26. The high pressure refrigerant air then is fed via duct 46 to the regenerative heat exchanger 16 where it again gives up heat to the low pressure recirculation air passed therethrough from air return 42 and duct 52. From the regenerative heat exchanger 16 the high pressure refrigerant air path is via duct 48 to turbine 10. After leaving the turbine 10 reduced in pressure and temperature, the refrigerant air is ducted via valve 22 and duct 56 to the load where, at outlet 44, it usefully cools the load and eventually returns to inlet duct 42 to be recirculated and re-enter the closed loop again at the ambient pressure side of regenerative heat exchanger 16.

Any moisture present in the refrigerant air is removed from the systems of FIGS. 1 and 2 by suitable drains at the high pressure exit 58 of the regenerative heat exchanger 16. In the heating mode to FIG. 1, any moisture in the turbine discharge is rejected to the ambient via duct 50 along with the turbine discharge airflow. In the refrigeration mode of FIG. 2, any moisture in the turbine discharge is drained from the cool air supply duct 56 via drain 60.

Figure 3:
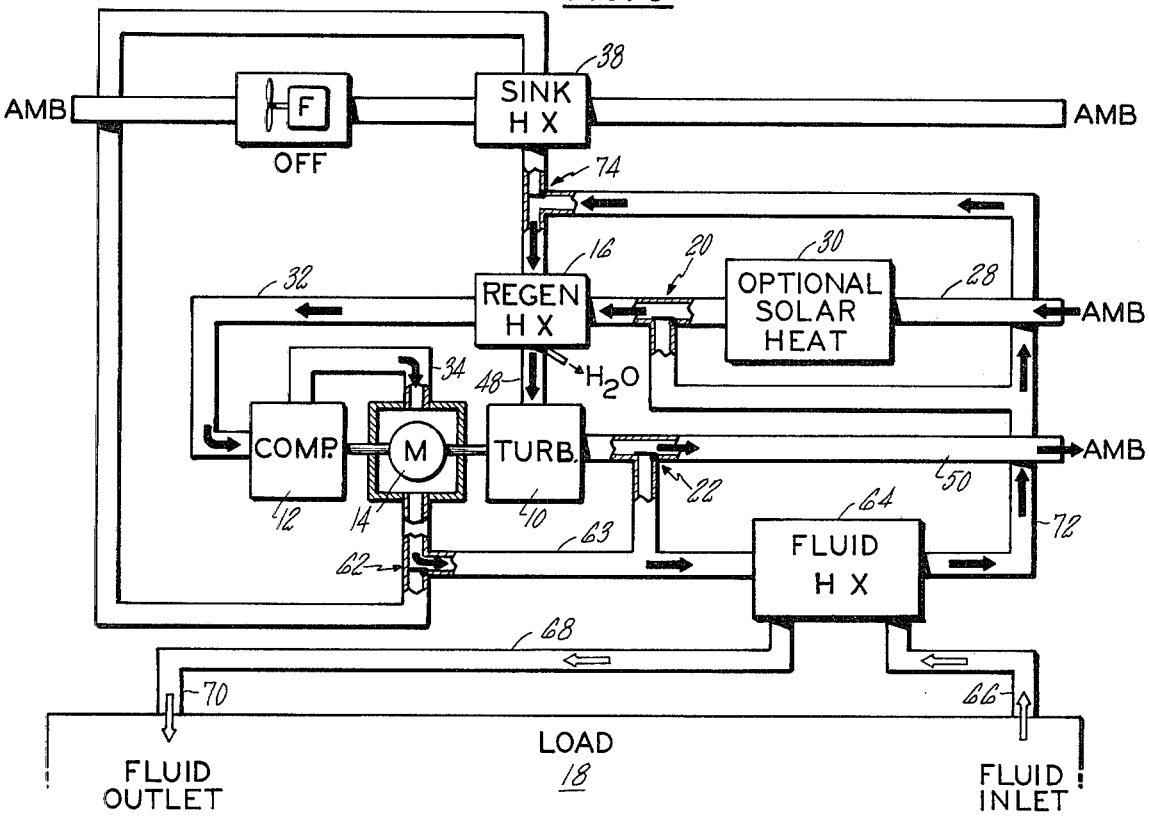
FIG. 3 is a schematic diagram of an air cycle heat pump system used for heating a recirculation fluid returning from a load and returning this heated fluid to the load.
Figure 4:
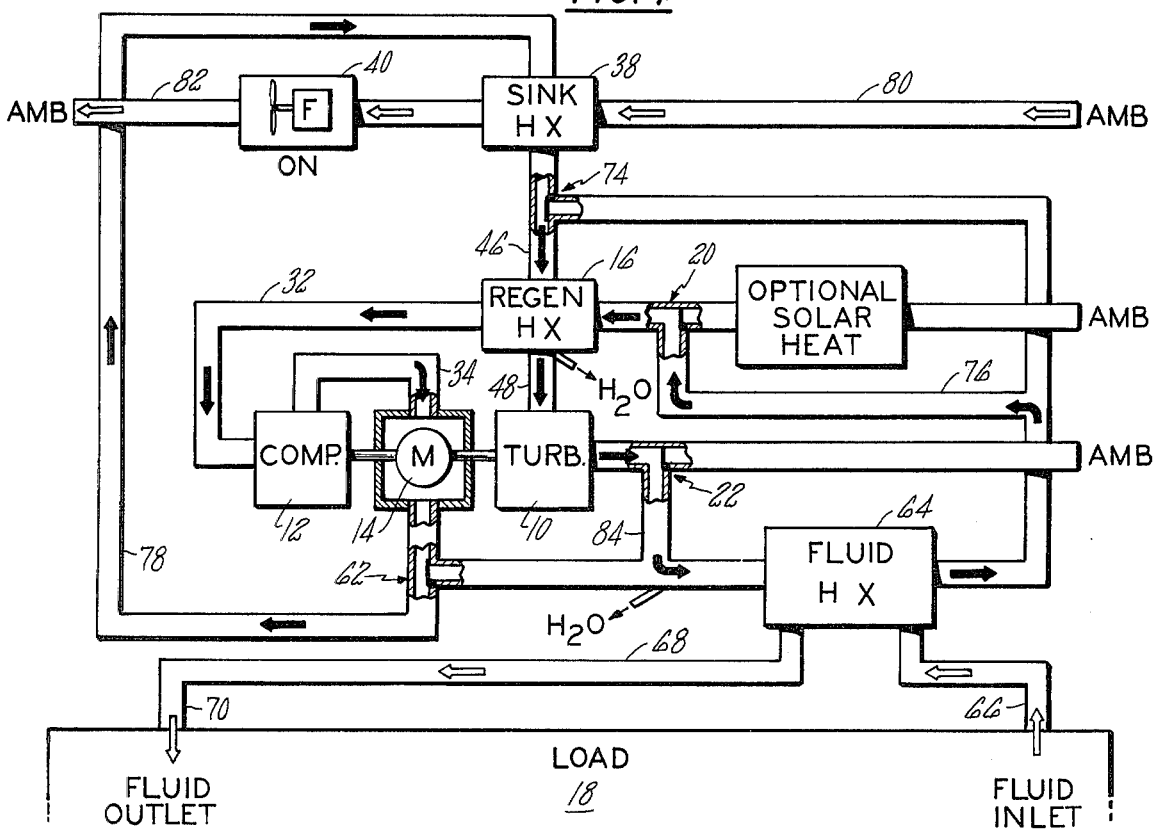
FIG. 4 is a schematic diagram of an air cycle refrigeration system using components similar to those of FIG. 3 used for cooling a recirculation fluid returning from a load and returning the cooled fluid to the load.

Referring to FIGS. 3 and 4 there are shown embodiments similar to FIGS. 1 and 2 respectively except that the load includes, in addition to load 18, a heat exchanger 64 through which a fluid such as water, independent of the refrigerant air, is recirculated. The major elements of the heat pump mode and refrigeration mode are essentially the same as in FIGS. 1 and 2.

Referring to FIG. 3, the position of two of the bidirectional valves has been rearranged, and a fluid heat exchanger added in the refrigerant path. Ambient air is fed via duct 28 through optional solar heat exchanger 30 and valve 20 to the ambient pressure side of regenerative heat exchanger 16. As in FIG. 1, the ambient air is used as the refrigerant air. The refrigerant air then proceeds via duct 32 to compressor 12, via duct 34 to cool the windings of motor 14, and then via valve 62 and duct 63 to the fluid heat exchanger 64. Also fed to the fluid heat exchanger 64 from fluid inlet 66 is the recirculation fluid recirculating between load 18 and heat exchanger 64. The major thermodynamic difference between FIGS. 1 and 3 is that in FIG. 3 the refrigeration air, after leaving motor 14, rejects its heat to the recirculation fluid in fluid heat exchanger 64, whereas in FIG. 1 it rejects its heat to recirculation air sink heat exchanger 38. In FIG. 3, the recirculation fluid from inlet 66, after gaining heat in fluid heat exchanger 64, returns to the load 18 via duct 68 and outlet 70. An optional solar heater may be used in the recirculation fluid path.

After rejecting its heat in fluid heat exchanger 64, the air in duct 63 proceeds via duct 72 and valve 74 to regenerative heat exchanger 16, via duct 48 to expansion turbine 10, and then through valve 22 to ambient via duct 50. This process is identical to that of FIG. 1. The sink heat exchanger and fan of FIG. 1 are not used in this embodiment.

In FIG. 4, the valves 20, 22, 62 and 74 of FIG. 3 are switched to place the system in the refrigeration mode. Also, the refrigerant air is used over and over in a closed path or loop in and out of the fluid heat exchanger, the closed loop being shorter than that of FIG. 2 where the turbine discharge air is passed through the load rather than a fluid heat exchanger before being recycled.

Referring to FIG. 4 the refrigerant air, after absorbing heat from the recirculation fluid in fluid heat exchanger 64, is fed via duct 76 and valve 20 to the ambient pressure side of regenerative heat exchanger 16, through duct 32 to compressor 12, then through duct 34 to cool the windings of motor 14, and then via duct 78 to sink heat exchanger 38. Ambient air is also fed through sink heat exchanger 38 from ambient air duct 80, and passes through fan 40 to ambient exhaust duct 82. The high pressure, high temperature air in duct 78 rejects some of its heat to the ambient air in sink heat exchanger 38. From the sink heat exchanger the refrigerant air passes via duct 46 and valve 74 to the high pressure side of regenerative heat exchanger 16 where it rejects additional heat, and then via duct 48 to turbine 10 where it is expanded and cooled and fed via duct 84 and valve 22 to the fluid heat exchanger 64. The recirculation fluid from inlet 66, after rejecting heat in fluid heat exchanger 64, returns to cool load 18 via duct 68 and outlet 70.

In general, the two implementations of FIGS. 1 and 2 relate to heating and cooling structures via a hot air furnace, whereas FIGS. 3 and 4 relate to baseboard hot water, and the subject is within the skill of plumbers and builders. This invention, as described, may be used with either.

While described with respect to preferred embodiments thereof and in the best mode contemplated, it is understood that modifications may be made to the operation and construction of the invention without departing from its scope as hereinafter claimed.

I claim:

1. A combined air cycle heat pump and refrigeration system for a load comprising:

a source of low pressure refrigerant air at essentially ambient pressure, said refrigerant air being ambient air when said system is operating in the heat pump mode and being air returned from said load when said system is operating in the refrigeration mode;

a turbine driven compressor receiving said refrigerant air and increasing the temperature and pressure thereof;

means for conducting said compressed refrigerant air to said turbine for expansion therein and discharge therefrom whereby said refrigerant air is reduced in temperature;

means for conducting the refrigerant air discharged from said turbine directly to the ambient when said system is operating in the heat pump mode, and for conducting the refrigerant air discharged from said turbine directly to said load when said system is operating in the refrigeration mode;

a regenerative heat exchanger connecting through heat transfer surfaces within said regenerative heat exchanger the source of low pressure refrigerant air with the compressed refrigerant air upstream of said turbine whereby said compressed refrigerant air rejects some of its heat to said low pressure refrigerant air from said source and reduces the temperature of the compressed refrigerant air fed to said turbine so as to maximize the reduction in the temperature of the refrigerant air discharged from said turbine;

additional heat exchange means downstream of said compressor and upstream of said regenerative heat exchanger on the high pressure side thereof, said compressed refrigerant air passing through said additional heat exchange means;

an additional fluid, said fluid being fluid returned from said load when said system is operating in the heat pump mode and said fluid being ambient air when said system is operating in the refrigeration mode;

means for passing said fluid through said additional heat exchange means in heat exchange relation with said compressed refrigerant air whereby said fluid absorbs heat from said compressed refrigerant air;

and means for returning said fluid to supply heat to said load when said system is operating in the heat pump mode and returning said fluid to ambient when said system is operating in the refrigeration mode.

2. A combined air cycle heat pump and refrigeration system as in claim 1 and including a plurality of two-way fluid valves connected with said low pressure refrigerant air source, with said turbine discharge air path and with said additional fluid path, said fluid valves being adapted to maintain said system in the heat pump mode in one position, and to maintain said system in the refrigeration mode in the other position.

3. A system as in claim 1 in which said additional load fluid is air.

4. A system as in claim 1 in which said additional load fluid is a liquid.

5. A system as in claim 1 and including electric motor means having coils for supplying additional torque to said compressor:

and means for passing the refrigerant air from said compressor through said motor coils to cool said coils and provide additional heat to said refrigerant air.

6. A heat pump system as in claim 1 and including solar heating means in the path between said source of ambient refrigerant air and said regenerative heat exchanger for providing additional heating to said ambient refrigerant air.

7. A system as in claim 1 and including means connected with said regenerative heat exchanger for removing moisture therefrom.

8. A combined air cycle heat pump and refrigeration system comprising:

a source of refrigerant air;

a regenerative heat exchanger having low pressure fluid passage means and high pressure fluid passage means in heat exchange relation;

means for passing said refrigerant air through the low pressure fluid passage means of said regenerative heat exchanger;

a compressor;

a turbine for providing torque to said compressor;

motor means for providing additional torque to said compressor;

means for passing said refrigerant air from the low pressure fluid passage means of said regenerative heat exchanger to said compressor, said compressor raising said refrigerant air in pressure and temperature;

additional heat exchange means receiving said compressed refrigerant air whereby some of the heat in said compressed refrigerant air is rejected to a fluid passed through said additional heat exchange means and in heat exchange relationship with said compressed refrigerant air;

means passing said compressed refrigerant air from said additional heat exchange means to the high pressure fluid passage means of said regenerative heat exchanger where additional heat from said compressed refrigerant air is rejected to the refrigerant air passed through the said low pressure fluid passage means of said regenerative heat exchanger;

and means for expanding the refrigerant air passed through the high pressure fluid passage means of said regenerative heat exchanger in said turbine.

9. A method for selectively heating and cooling a load utilizing an air cycle comprising the steps of:

providing a first source of air from said load and returning said load air to said load;

providing a second source of ambient air and returning said ambient air to ambient;

selecting one of said first or second air sources as refrigerant air, said first air source being selected when it is desired to cool said load and said second air source being selected when it is desired to heat said load;

compressing said refrigerant air to increase the pressure and temperature thereof;

expanding said compressed refrigerant air in a turbine and discharging said refrigerant air therefrom;

connecting through heat transfer surfaces within a regenerative heat exchanger the source of refrigerant air with the compressed refrigerant air upstream of said turbine whereby said compressed refrigerant air rejects some of its heat to said refrigerant air from said source, thereby reducing the temperature of the compressed refrigerant air expanded in said turbine so as to maximize the reduction in temperature of air discharged from said turbine;

and connecting through heat transfer surfaces within an additional heat exchanger located upstream of said regenerative heat exchanger and compressed refrigerant air with the other of said first or second air sources whereby said compressed refrigerant air rejects heat to said other air source.

10. In an air cycle refrigeration machine using ambient air as the refrigerant air and operating as a heat pump to supply heat to a load;

a turbine driven compressor receiving said refrigerant ambient air and increasing the temperature and pressure thereof;

a first heat exchanger downstream from said compressor;

means for circulating a fluid from said load through said first heat exchanger and returning said fluid to said load;

means connecting said compressed refrigerant air from said compressor through heat transfer surfaces in said first heat exchanger with said fluid whereby said compressed refrigerant air rejects heat to said fluid, said heated fluid being used to provide heat to said load;

a regenerative heat exchanger downstream from said first heat exchanger and connecting through heat transfer surfaces within said regenerative heat exchanger the ambient air used as the refrigerant air with the pressurized refrigerant air from said first heat exchanger whereby said pressurized refrigerant air rejects some of its heat to said ambient air and reduces the temperature of said pressurized refrigerant air to as close to ambient as possible;

and means for conducting said pressurized refrigerant air from said regenerative heat exchanger to said turbine for expansion therein, said turbine cooling said refrigerant air and discharging said cooled refrigerant air to ambient at a temperature as far below ambient as possible.

11. In an air cycle refrigeration machine using a source of air from a load as the refrigerant and operating as a refrigeration machine to cool said load;

a turbine driven compressor receiving said refrigerant air from said load and increasing the pressure and temperature thereof;

a first heat exchanger downstream from said compressor;

means for providing a source of ambient air to said first heat exchanger and discharging said ambient air to ambient;

means connecting said compressed refrigerant air from said compressor through heat transfer surfaces within said heat exchanger with said ambient air whereby said compressed refrigerant air rejects heat to said ambient air;

a regenerative heat exchanger downstream from said first heat exchanger and connecting through heat transfer surfaces within said regenerative heat exchanger the source of refrigerant air from said load with the pressurized refrigerant air from said first heat exchanger whereby said pressurized refrigerant air rejects some of its heat to said refrigerant air from said load and reduces the temperature of said pressurized refrigerant air to as close to the refrigerant air temperature from said load as possible;

and means for conducting said pressurized refrigerant air from said regenerative heat exchanger to said turbine for expansion therein, the turbine discharge air being conducted to said load to cool said load, said turbine discharge air being as far below load temperature as possible.

* * * * *